United States Patent [19]

Driscoll

[11] 3,969,471

[45] July 13, 1976

[54] PROCESS OF MANUFACTURING CHROMIC ACID TREATED FOAM FIBRILLATED WEBS

[75] Inventor: Gary L. Driscoll, Boothwyn, Pa.

[73] Assignee: Sun Research and Development Co., Philadelphia, Pa.

[22] Filed: Jan. 2, 1973

[21] Appl. No.: 320,352

[52] U.S. Cl. ..... 264/50; 156/79; 156/229; 156/306; 260/2.5 E; 264/53; 264/54; 264/210 R; 264/340; 264/DIG. 8; 428/107; 428/523; 428/910

[51] Int. Cl.[2] ..... B29D 7/24; B29D 27/00; B29D 7/20

[58] Field of Search ..... 264/51, 53, 54, DIG. 8, 264/22, 210 R, 340; 156/152, 272, 307, 316, 79, 229, 306; 117/47 A, 93.1; 260/2.5 E; 428/107, 523, 910

[56] References Cited

UNITED STATES PATENTS

| | | | |
|---|---|---|---|
| 2,668,134 | 2/1954 | Horton | 156/316 |
| 2,886,471 | 5/1959 | Bruce et al. | 117/47 A X |
| 2,998,324 | 8/1961 | Hirt | 117/47 A |
| 3,099,572 | 7/1963 | Rion et al. | 117/47 A |
| 3,169,899 | 2/1965 | Steuber | 264/DIG. 8 |
| 3,515,615 | 6/1970 | Okada et al. | 156/272 |
| 3,539,666 | 11/1920 | Schirmer | 264/DIG. 8 |
| 3,562,369 | 2/1971 | Chopra et al. | 264/DIG. 8 |
| 3,576,931 | 4/1971 | Chopra et al. | 264/DIG. 8 |
| 3,754,117 | 8/1973 | Walter | 156/272 X |
| 3,860,369 | 1/1975 | Brethauer et al. | 264/22 X |
| R24,062 | 9/1955 | Horton | 117/47 A X |

FOREIGN PATENTS OR APPLICATIONS

| | | | |
|---|---|---|---|
| 1,171,971 | 1/1968 | United Kingdom | 264/DIG. 8 |
| 1,192,132 | 5/1970 | United Kingdom | 264/DIG. 8 |

OTHER PUBLICATIONS

*The Condensed Chemical Dictionary*, Eighth Edition, Revised by Gessner G. Hawley, New York, Van Nostrand Reinhold, c1971, p. 87.

*The Naming and Indexing of Chemical Compounds From Chemical Abstracts*, Introduction to the Subject Index of vol. 56. Washington, D.C., American Chemical Society, (1962). pp. 12N–15N, 37N–40N, 44N–45N, 87N–89N, 94N–95N.

McLaren, A. D.; T. T. Li; Robert Rager; and H. Mark. "Adhesion IV. The Meaning meaning of Tack Temperature;" in Journal of Polymer Science. vol. VII, No. 5, pp. 463–471 (1951).

Muus, Laurits T.; N. Gerard McCrum, and Frank C. McGrew "On the Relationship of Physical Properties to Structure in Linear Polymers of Ethylene and Propylene." In *SPE Journal* May, 1959, pp. 368–372.

Sharpe, Louis H. and Harold Schonhorn, "Surface Energetics, Adhesion, and Adhesive Joints." *In Contact Angle, Writability, and Adhesion* The Kendall Award Symposium, honoring William A. Zisman, Sponsored by the Division of Colloid and Surface Chemistry at the 144th Meeting of the American Chemical Society, Los Angeles, Calif., Apr. 2–3, 1963, Washington, D.C. American Chemical Society, 1964, pp. 189–201.

*Primary Examiner*—Philip Anderson

*Attorney, Agent, or Firm*—J. Edward Hess; Donald R. Johnson; Anthony Potts, Jr.

[57] ABSTRACT

Non-woven fabrics are produced from polyolefin foam fibrillated webs. The webs are treated with an aqueous solution of a small amount of chromic acid in strong sulfuric acid to improve the adhesion thereof when they are laminated under heat and pressure to form a non-woven fabric.

1 Claim, 2 Drawing Figures

PROCESS OF MANUFACTURING CHROMIC ACID TREATED FOAM FIBRILLATED WEBS

BACKGROUND OF THE INVENTION

In the past there has been considerable effort to find a way of forming fabric-like materials by means other than weaving or knitting, due to the expense involved therein. Weaving fabrics is a particularly expensive operation, and especially so when the woven material is made from fiber slivers. Woven slit film eliminates the carding or garneting of fibers, but still involves the expensive weaving operation. Needle punching of layers of fibrillated films is used for some purposes but for many purposes the layers are not sufficiently unitized. Bonding of polyolefin fibrillated webs has generally not been used because of insufficient adhesion of the webs.

SUMMARY OF THE INVENTION

The present invention relates to surface treating polyolefin foam fibrillated webs so as to improve their adhesion to each other when they are assembled to form a non-woven fabric. The web is formed of polyethylene, polypropylene, copolymers of ethylene and propylene or blends thereof. The webs are treated with an aqueous solution of 90 to 100% sulfuric acid containing from 1 to 20 wt. % chromic acid, at from 25° to 100°C for from 0.1 second to 3 minutes. The webs are assembled into a plurality of layers by any suitable means such as simply unrolling some webs onto a carrier belt and cross-lapping some other layers to provide strength across the machine direction of the final non-woven fabric. The assembled layers are finally laminated together using a combination of heat and pressure. An adhesive may be used if desired but its presence is not required.

DESCRIPTION OF THE DRAWINGS

In FIG. 1 the polyolefin is fed to hopper 1 of feed meterer 2, along with whatever blowing agent is required. The polyolefin is fed at a controlled rate from feed meterer 2 to the feed hopper 3 of extruder 4 as free falling pellets 5. Extruder 4 is equipped with a slit die 6, the slit of which is offset from the extruder feedport so as to create sufficient back pressure to provide for a uniform feed rate across the width of the die. The extrudate is taken up and attenuated by a first pair of nip rolls 7,7'. As the extrudate leaves the die lips it is air quenched by means of an air quench manifold 8 which is provided with ports directed at the extrudate. A hood 9 is provided to remove the gaseous blowing agent from the atmosphere since the blowing agent may contain noxious fumes. First pair of nip rolls 7,7' are operated at a surface rate speed of from 2 to 25 times the linear rate at which the polyolefin is supplied to the lips of die 6 by extruder 4. This serves to break the foam bubbles within die 6 as they approach the lips of die 6 or immediately as they leave die 6, whereby a foam fibrillated web 10 is formed. The foam fibrillated web 10 is passed over heated shoe 11, and drawn by a second pair of nip rolls 12,12'. Generally second pair of nip rolls 12,12' are driven at a surface speed rate of from 2 to 10 times the surface speed rate of first pair of nip rolls 7,7' to orient and thereby strengthen foam fibrillated web 10.

Figure 1:
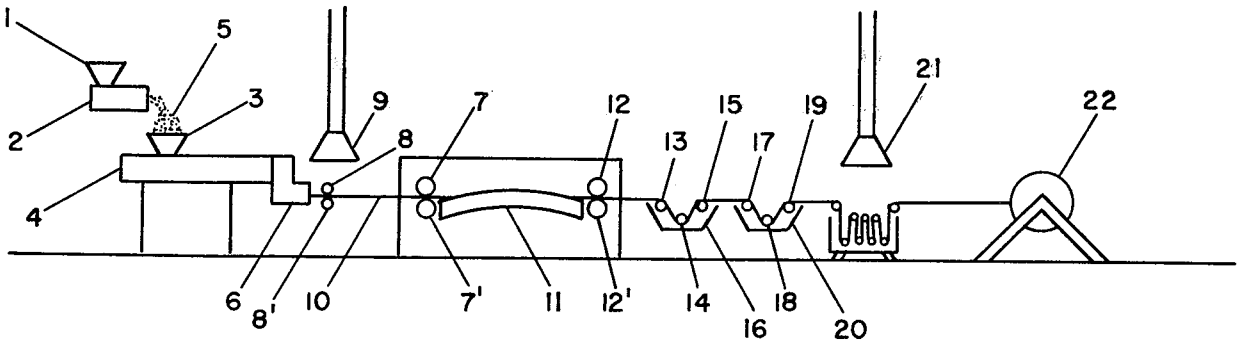
FIG. 1 is a schematic side view of the foam extrusion and fibrillation apparatus.

The thus oriented foam fibrillated web 10 is then passed over rollers 13, 14 and 15 and through trough 16 containing aqueous sulfuric acid and chromic acid to treat the surface of the foam fibrillated web 10. The surface treated foam fibrillated web 10 is then passed over rollers 17, 18 and 19 and through trough 20 containing water to wash off any acid residue remaining on foam fibrillated web 10. The foam fibrillated web 10 is then passed through heater and hood assembly 21 to remove moisture therefrom and is taken up on take-up reel 22.

Figure 2:
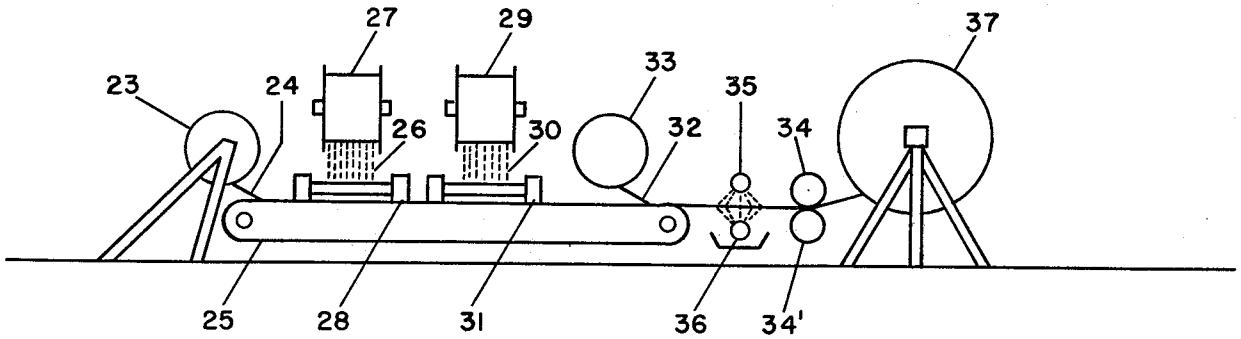
FIG. 2 is a schematic side view of the laminating apparatus.

In FIG. 2 a reel 23 supplies foam fibrillated web 24 to carrier belt 25. An additional layer of foam fibrillated web 26 is fed from reel 27, supported overhead by means not shown, to lapper 28. Lapper 28 contains a pair of driven nip rolls mounted in a carriage. The nip rolls feed the foam fibrillated web 26 onto first foam fibrillated web 25. This results in the foam fibrillated web being laid down at a 45° angle to the machine direction in a double thickness. Another reel 29 supplies foam fibrillated web 30 to second lapper 31 onto lapped foam fibrillated web 26 to form two layers of foam fibrillated web 30 disposed at 45° to the machine direction. A final layer of foam fibrillated web 32 is fed from reel 33 onto foam fibrillated web 30. The entire lay-up of foam fibrillated webs is then removed by carrier belt 25 and passed through heated laminating rolls 34,34'. If desired adhesive may be applied to the lay-up of foam fibrillated webs by means of sprayers 35 and 36. The laminated foam fibrillated webs are then taken up on take-up reel 37.

DETAILED DESCRIPTION

In preparing the foam fibrillated webs of the present invention several extrusion and drawing techniques may be employed. The drawings show the preferred technique. However, for instance the extruder may be fed by any suitable means including manually from sacks of polyolefin resin. A slit die has been shown and has been found most convenient for forming relatively narrow width webs of from say 6 inches to 5 feet. For wider webs of say 3 to 20 feet an annular die has obvious advantages. When using such an annular die the web is drawn over a mandrel to maintain or slightly increase its circumference during orientation.

The extruder used may be equipped with a port to inject the blowing agent. If this is done, various blowing agents may be used such as the Freons, methylene chloride, nitrogen, carbon dioxide, etc. If the extruder is not equipped with a port to inject the blowing agent, the blowing agent is fed into the extruder along with the polyolefin. While this can be done by coating the polyolefin pellets with a low boiling liquid such as pentane which becomes a gas at the elevated temperature in the extruder, it is preferred to use a solid blowing agent. Such solid blowing agent is physically or chemically decomposed to form a gas in the extruder. Exemplary solid blowing agents include but are not limited to azobisformamide, azobisisobutyronitrile, diazoaminobenzene, 4,4'-oxybis(benzenesulfonylhydrazide), benzenesulfonylhydrazide, N,N'-dinitrosopentamethylenetetramine, trihydrazino-symetriazine, p,p'-oxybis(benzenesulfonylsemicarbazide)-4-nitrobenzene sulfonic acid hydrazide, beta-naphthalene sulfonic acid hydrazide, diphenyl-4,4'-di(sulfonylazide) and mixtures of materials such as sodium bicarbonate with a solid acid such as tartaric acid. The amount of blowing agent to be used in the process generally is in the range of from 0.1 to 20 wt. % of the polyolefin being extruded with from 0.5 to 5.0 wt. % being the preferred range.

The polyolefin used generally will have a melt index of below 30. Almost any commercial poly α-olefin plastic is suitable whether it be molding, film or fiber grade. Generally at least 70 wt. % of the web is poly α-olefin. Thus the web can contain up to 30 weight percent of another polymer such as polystyrene or ethylene-vinyl acetate copolymer.

As the polyolefin is extruded it is taken up by a take-up means such as a first pair of nip rolls and attenuated about two to 25 times. This attenuation serves to cause the foam bubbles forming within the die to break as the blend approaches the die lips resulting in a network or web of intertwined and connected fibrils. The temperature of the polyolefin is generally maintained at from 120° to 315°C. From 190° to 230°C is the preferred range for polypropylene. From 150° to 200°C is the preferred range for polyethylene. As the polyolefin leaves the die lips it is quenched by any suitable means such as an air quench which serves to insure that the polyolefin is rapidly solidified to develop sufficient strength to be drawn away from the die which is below about 150°C in the case of polypropylene and below about 110°C in the case of polyethylene. This causes the foam bubbles which were forming as the pressure imposed on the polyolefin drops as the polyolefin approaches the die lips to rupture and form fibrils rather than merely to expand into larger bubbles. After this foam fibrillated web has been formed it is then stretched to orient the polyolefin which makes up the individual fibrils which in turn make up the web, thereby strengthening the web. Normally this stretching is from two to 10 times but in any case is below where breakage of the web occurs. Generally the webs are stretched at a moderately elevated temperature. Suitable temperatures are from 90° to 150°C.

The webs are then subjected to treatment with chromic acid and sulfuric acid. This treatment is generally carried out at a moderate temperature of from 25° to 100°C. Usually the treatment is carried out in from 0.1 second to 3 minutes. Less than this amount of time is usually insufficient to effect much improvement in the adhesion of the webs while more time can result in deterioration of the polyolefin. Generally the sulfuric acid strength of the aqueous solution is from 90 to 100 wt. % and the chromic acid strength is from 1 to 20 wt. %. This treatment serves to markedly improve the bonding of the webs together. This improvement is observed both when the webs are laminated neat by heat and pressure and when an adhesive is used.

The adhesive can be a liquid which is sprayed, doctored or otherwise applied to whatever webs are to be assembled into a non-woven fabric. Any thermoplastic adhesive which softens in the range of from 100° to 170°C can be used or a cross-linking formulation may be applied. The commercially available ethylene-vinyl acetate copolymer emulsions are particularly satisfactory adhesives for the purpose.

Generally the die used to extrude the webs has an opening of from 15 to 25 mils in the thickness direction which results in the final oriented foam fibrillated webs weighing from 0.2 to 0.8 ounces per square yard. Generally the final non-woven fabric will contain from three to 20 layers of web. For most uses such as industrial bagging, primary carpet backing, secondary carpet backing, wallpaper, upholstery backing, etc. from five to 10 layers of web are used and the non-woven fabric product has a weight of from 2.5 to 10 ounces per square yard. There are a plurality of ways in which the layers of webs can be assembled. Often the way in which the webs are assembled is dependent on the use to which the non-woven product is to be put. Usually this involves three to four layers in the machine direction and two to six layers at an angle thereto. However the webs can be run through a tenter frame to increase their width two to six times which imparts a biaxial disposition to the direction of the individual fibrils within the web, in which case all of the webs can be laid down in the machine direction and laminated.

For individual laminates of from about 6 inches square up to about 4 × 8 ft. a press can be used to laminate the foam fibrillated webs together. Generally such a press is operated at from 10 to 500 p.s.i. and at 90° to 150°C. For long rolls of the non-woven product heated pressure rolls are used. Generally these are heated metal rolls, preferably steel rolls or coated steel rolls, operated at from 2 to 200 lbs. per lineal inch pressure, from 90° to 150°C and the material being laminated is fed at a rate of from 10 to 300 feet per minute. The hand, appearance, porosity and other physical characteristics of the non-woven fabric product can be varied considerably by varying the severity of the laminating conditions within the parameters set forth above. Further these characteristics of the product non-woven fabric can be varied by using embossed or textured laminating rolls. If one (or if desired both) laminating rolls (or one or both surfaces of a press if such is being used) are covered with burlap or a screen of the appropriate size mesh a non-woven fabric which looks like burlap can readily be obtained. This is a distinct advantage over most other non-woven fabrics or even woven slit film in the production of secondary carpet backing where aesthetics are important and where burlap, which is now in short supply, has been the traditional material used.

EXAMPLES

A Killian 1 inch extruder having a 24:1 length to diameter ratio screw is equipped with an 8 inch wide slit die having a 20 mil thick opening. The slit is offset from the screw by 10 inches and extrudes in a direction parallel to the direction of the extruder barrel. The extruder hopper is hand filled with a blend of polypropylene having a melt index of 10 and 1 wt. % of Celogen AZ (azodicarbonamide). The extruder barrel is maintained at 204°C and the die at 218°C. The screw is operated at 25 rpm. Immediately adjacent the die lips is an air quench which is a pair of 0.5 inch diameter pipes one located above the die lips and the other below the die lips containing air under 80 p.s.i. pressure. Each pipe contains a row of .030 inch diameter holes .125 inch apart directed at the die lips. The extrudate is withdrawn from the die lips by a first pair of 5 inch diameter nip rolls 8 inches in width driven at a surface speed of 10 ft./min. to form a foam fibrillated web. These rolls comprise a driven rubber covered roll and a stainless steel idler roll. The foam fibrillated web is then passed over a heated shoe 8 inches wide and 36 inches long. The shoe is slightly arched in shape so as to maintain the foam fibrillated web in intimate contact with it. The shoe is maintained at 135°C. The foam fibrillated web is then passed between a second pair of nip rolls identical to the first pair of nip rolls operated at a surface speed of 35 ft./min. and is then taken up on a take-up reel.

A 3 foot length of the foam fibrillated web is treated for 1 minute in a 1000 ml beaker containing 600 ml of an aqueous solution of 2 wt. % chromic acid in 96% sulfuric acid at 80°C. The web is cut into six 6-inch squares which are laid up by hand with three layers in one direction and three layers at right angles thereto. The six layers of web are then laminated by pressing at 150°C and 10,000 pounds total pressure for 3 minutes. Tensile strips 6 inches long and 1 inch side are cut at 45° from the direction of the webs. These strips exhibited a strength of 0.05 g/denier versus controls which were not surface treated of <0.01 g/denier. This strength test is directly dependent on bond strength since the pairs of jaws of the tester are spaced 3 inches apart and since the fibrils within the individual webs are at a 45° angle to the pulling direction none of them are being pulled by both pairs of jaws.

The invention claimed is:

1. A process of producing a foam-fibrillated fibrous web comprising extruding a blend of a molten polyolefin resin selected from the group consisting of polyethylene, polypropylene, copolymers of ethylene and propylene or blends thereof, and a gaseous blowing agent from a die into a zone of reduced pressure to produce an extrudate, withdrawing said extrudate from said die by a first take-up means at a linear rate from 2 to 25 times the linear rate at which said blend of molten polyolefin resin and gaseous blowing agent reaches the die lips to form a foam fibrillated web, stretching said foam fibrillated web from two to 10 times in the machine direction, and surface treating the stretched foam fibrillated web in from 90 to 100% sulfuric acid containing from 1 to 20 wt. % chromic acid at from 25° to 100°C. for from 0.1 second to 3 minutes whereby the fibrous web has improved adhesion ability with itself.

* * * * *